US005494137A

United States Patent [19]

Kowalczyk et al.

[11] Patent Number: 5,494,137

[45] Date of Patent: Feb. 27, 1996

[54] ELEVATOR DOOR MOUNTING SYSTEM

[75] Inventors: Thomas M. Kowalczyk, Farmington; Jerome F. Jaminet, South Windsor; Thomas M. McHugh, Farmington; Edward E. Ahigian, West Hartford; Thomas He, Unionville; Richard E. Peruggi, Glastonbury; Richard E. Kulak, Bristol; David W. Barrett, East Hartland, all of Conn.

[73] Assignee: Otis Elevator Company, Farmington, Conn.

[21] Appl. No.: 224,357

[22] Filed: Apr. 7, 1994

[51] Int. Cl.[6] ..... B66B 13/06

[52] U.S. Cl. ..... 187/334; 49/409

[58] Field of Search ..... 187/334, 333; 49/409, 425, 120, 116

[56] References Cited

U.S. PATENT DOCUMENTS

| | | | |
|---|---|---|---|
| 4,099,599 | 7/1978 | Randall | 187/334 |
| 4,177,881 | 12/1979 | Kappenhagen | 187/334 |
| 5,172,518 | 12/1992 | Yoshino | 49/360 |

*Primary Examiner*—Kenneth Noland

[57] ABSTRACT

A reciprocating elevator cab door is mounted on a guide track assembly which is fixed to the cab. The cab door is provided with guide rollers which travel along the upper surface of the guide track as the door opens and closes. The door is also provided with at least one upthrust roller which engages the lower surface of the guide track so as to stabilize the door against rocking motion as it moves back and forth over the guide track. The upthrust roller is preferably spring biased against the guide track. Use of the upthrust roller allows greater flexibility of door drive systems.

6 Claims, 1 Drawing Sheet

ELEVATOR DOOR MOUNTING SYSTEM

TECHNICAL FIELD

This invention relates to an elevator cab door guidance system which counteracts tendencies of the cab doors to tilt or rock during opening and closing movement of the cab doors.

BACKGROUND ART

Elevator cab doors are opened and closed by moving them back and forth over guide tracks which are mounted on the cab. The door drive systems which are typically used on elevator cabs employ a rotary motor mounted on the roof of the cab, which motor actuates a complicated set of articulated arms which are pivotally connected to the cab doors. When the motor rotates in a first direction, the arms operate to move the doors away from each other so as to open the elevator doors. Rotation of the motor in the opposite direction causes the arms to move the doors toward each other so as to close the elevator doors. The doors are mounted on the guide track by means of rollers which engage the upper surface of the guide track. In order to provide smooth and continuous engagement between the rollers and the guide track as the doors are opened and closed, the articulated arms must be attached to the doors at the center of gravity of the latter. If this parameter is not met, the doors will tend to tilt or rock as they move over the guide tracks, wherein one of the guide rollers may actually be lifted off of the track. This problem is exacerbated in high performance door systems wherein an opening or closing time of less than 1.5 seconds for 1100 mm door openings is the objective. Rocking of the doors during opening and closing is visually unacceptable, and creates undesirable noise levels and cab vibration.

DISCLOSURE OF THE INVENTION

This invention relates to an elevator cab door guidance system that eliminates cab door rocking during opening and closing irrespective of the locus of the driving attachment points on the doors. The door guidance system of this invention thus provides added design flexibility in that a variety of different and less complex door drives can be used. The door guidance system of this invention utilizes the conventional guide rollers mounted on the doors which engage the upper surface of the track, and also includes at least one upthrust roller mounted on the door, which upthrust roller engages the lower surface of the track in a manner which prevents the upper rollers from being lifted away from the track. The assembly can include an upthrust roller disposed directly opposite each guide roller so as to form pairs of guide rollers on the door. Alternatively, one or more upthrust rollers can be mounted on the door at locations which are between the guide rollers so that the upthrust rollers are offset from the guide rollers along the track, and are not directly opposite the guide rollers. In either case, the upthrust rollers will serve to stabilize the guide roller-guide rail engagement, and will prevent rocking of the doors on the guide tracks. The upthrust rollers will preferably be provided with spring biasing assemblies which will supply a flexible and adjustable upthrust force to the upthrust rollers.

It is therefore an object of this invention to provide an elevator door guidance system which enables the doors to move between open and closed positions with minimum noise and vibration.

It is a further object of this invention to provide an elevator door guidance system of the character described which is operable to suppress door rocking tendencies during opening and closing movement of the doors.

It is another object of this invention to provide an elevator door guidance system of the character described which is capable of ensuring smooth door motion with a variety of door drive systems.

It is an additional object of this invention to provide an elevator door guidance system of the character described which is adjustable, and can be retrofitted onto existing equipment.

It is yet another object of this invention to provide an elevator door guidance system of the character described which suppresses door rocking tendencies even at relatively high door operating speeds.

These and other objects and advantages of the invention will become more readily apparent from the following detailed description of the invention when taken in conjunction with the accompanying drawings, in which:

BEST MODE FOR CARRYING OUT THE INVENTION

Figure 1:
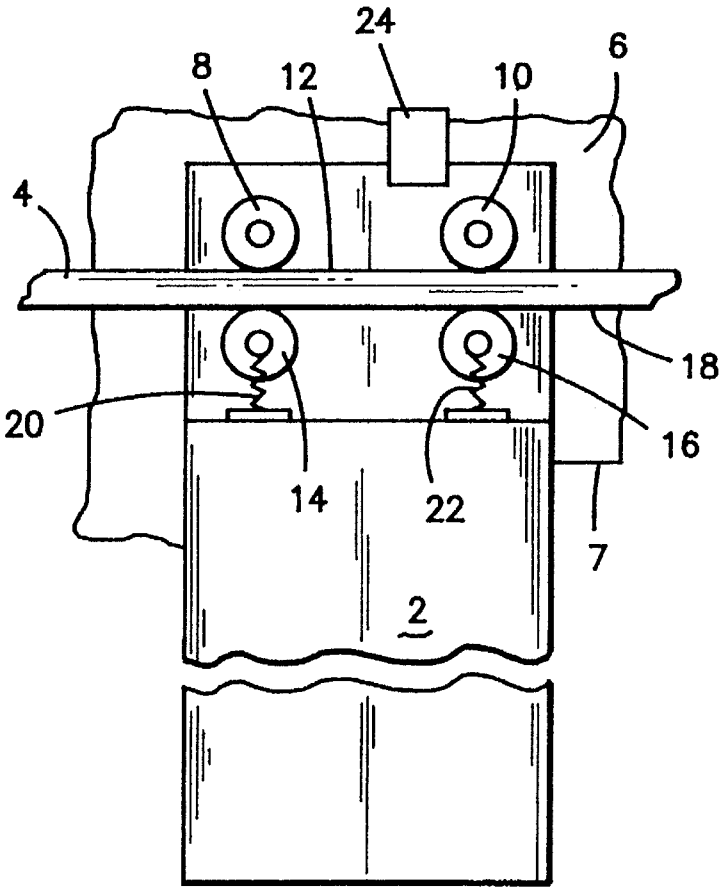
FIG. 1 is a fragmented schematic elevational view of one embodiment of a door guidance assembly formed in accordance with this invention.

Referring now to the drawings, FIG. 1 is a front elevational view of an elevator door panel 2 which is reciprocally slidably mounted on a track 4 that is secured to the elevator cab 6 above the cab entrance 7. Guide rollers 8 and 10 are mounted on the door 2 and engage and roll along the upper surface 12 of the track 4. Upthrust rollers 14 and 16 are also mounted on the door 2 and engage the lower surface 18 of the track 4. Spring biasing assemblies 20 and 22 mounted on the door 2 provide a resilient biasing force which urges the upthrust rollers 14 and 16 respectively against the lower surface 18 of the track 4. It will be noted that the upthrust rollers 14 and 16 are positioned directly opposite the guide rollers 8 and 10 respectively, so that the roller pairs 8, 14 and 10, 16 effectively form a pair of pressure nips through which the track 4 passes. The nip formed by the rollers 8 and 14 tends to suppress clockwise rocking motion of the door 2, and the nip formed by the rollers 10 and 16 tends to suppress counter clockwise rocking of the door 2. A door drive mechanism 24 shown schematically in FIG. 1 is mounted on the cab 6 and is operable to selectively move the door 2 to the left or to the right over the track 4 to affect opening and closing of the entrance to the cab 6. The door drive mechanism may be, for example, a linear motor mechanism, and it need not drive the door 2 at the center of gravity of the latter because of the ability of the mounting assembly to suppress motion-induced rocking of the door 2.

Figure 2:
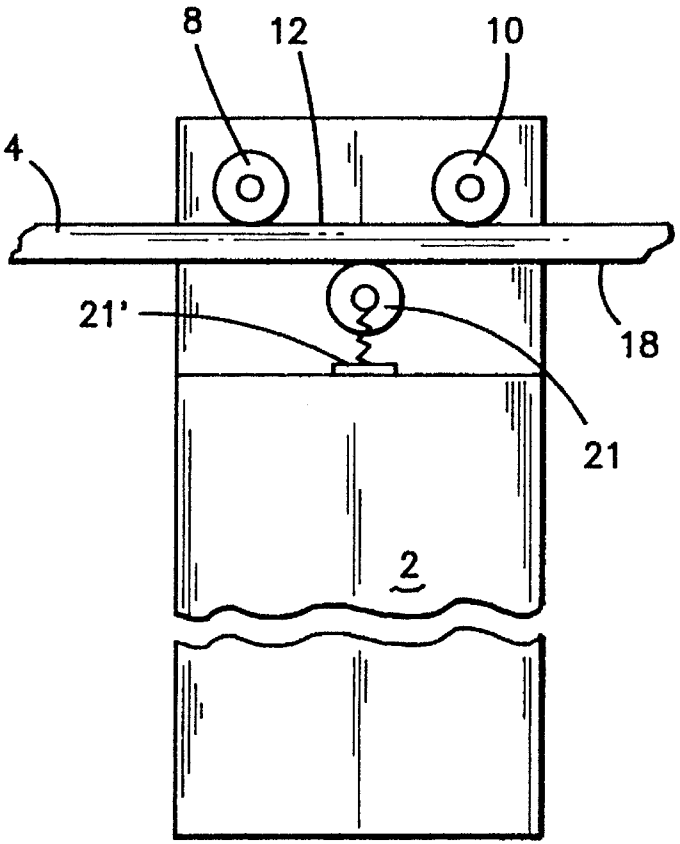
FIG. 2 is a view similar to FIG. 1 but showing another embodiment of a door guidance assembly formed in accordance with this invention.

FIG. 2 illustrates an alternative embodiment of the guide system of this invention which utilizes an upthrust roller 21 that engages the lower surface 18 of the guide track 4 at a point between the point of contact of the guide rollers 8 and 10 with the upper surface 12 of the guide track 4. The upthrust roller 21 is preferably biased against the track 4 by a biasing spring assembly 21'. The upthrust roller 21 is thus capable of suppressing both clockwise and counter clockwise rocking of the door 2 as the latter moves back and forth over the track 4. This alternative embodiment of the invention will serve to suppress rocking motion of the door at lower door speeds. More than one upthrust roller 21 can be mounted on the door 2 between the guide rollers 8 and 10, if necessary.

It will be appreciated that the elevator cab door mounting system of this invention will provide suppression of any tendencies of the doors to pivot or rock as they move between their open and closed positions on the elevator cab. The elevator door mounting system thus ensures quieter, vibration-free door opening and closing movement. The quiescent, low vibration door operation is independent of door opening and closing speed; and does not depend on the location of the door drive connection with respect to the center of gravity of the door. The elevator door mounting system of this invention thus provides increased door drive system flexibility.

Since many changes or variations of the disclosed embodiment of this invention may be made without departing from the inventive concept, it is not intended to limit the invention otherwise than as required by the appended claims.

What is claimed is:

1. A system for mounting an elevator door on an elevator cab, said system comprising:

a) a track fixedly mounted on said cab above an entrance to the cab;

b) an elevator cab door reciprocally slidably movable on said track between entrance-open and entrance-closed positions;

c) a plurality of guide rollers rotatably mounted on said cab door, said guide rollers being disposed in rolling contact with an upper surface of said track to guide movement of said door on said track;

d) at least one upthrust roller rotatably mounted on said cab door, said upthrust roller being disposed in rolling contact with a lower surface of said track and biased against said lower surface and being operable to suppress tilting of said door relative to said track as said door is moved between said entrance-open and entrance-closed positions; and e) drive means mounted on said cab and engaging said door to provide motive power to move said door over said track, said drive means engaging said door at a location which does not define the center of gravity of said door.

2. The system of claim 1 wherein there is an upthrust roller paired with and opposite to each guide roller.

3. The system of claim 1 wherein said upthrust roller is disposed midway between said guide rollers.

4. The system of claim 1 further comprising spring means for biasing said upthrust roller against said lower surface of said track.

5. The system of claim 1 wherein said drive means engages an upper edge portion of said door above said track.

6. A system for mounting an elevator door on an elevator cab, said system comprising:

a) a track fixedly mounted on said cab above an entrance to the cab;

b) an elevator cab door reciprocally slidably movable on said track between entrance-open and entrance-closed positions;

c) a plurality of guide rollers rotatably mounted on said cab door, said guide rollers being disposed in rolling contact with an upper surface of said track to guide movement of said door on said track;

d) at least one upthrust roller rotatably mounted on said cab door, said upthrust roller being disposed midway between said guide rollers in rolling contact with a lower surface of said track and being operable to suppress tilting of said door relative to said track as said door is moved between said entrance-open and entrance-closed positions; and e) drive means mounted on said cab and engaging said door to provide motive power to move said door over said track, said drive means engaging said door at a location which does not define the center of gravity of said door.

* * * * *